US006715216B1

(12) United States Patent
Salameh et al.

(10) Patent No.: US 6,715,216 B1
(45) Date of Patent: Apr. 6, 2004

(54) CLOTHES DRYER WITH FIRE SUPPRESSION SYSTEM

(75) Inventors: Naom Salameh, Louisville, KY (US); Stanley T. Wheeler, Louisville, KY (US)

(73) Assignee: Cissell Manufacturing Company, Louisville, KY (US)

( * ) Notice: Subject to any disclaimer, the term of this patent is extended or adjusted under 35 U.S.C. 154(b) by 0 days.

(21) Appl. No.: 10/618,000

(22) Filed: Jul. 11, 2003

(51) Int. Cl.[7] ..... F26B 3/00

(52) U.S. Cl. ..... 34/350; 34/544; 34/570; 34/575; 34/595; 34/90

(58) Field of Search ..... 34/343, 350, 526, 34/544, 570, 575, 595, 89, 90

(56) References Cited

U.S. PATENT DOCUMENTS

| | | | |
|---|---|---|---|
| 2,790,247 | A | 4/1957 | Olthuis |
| 2,792,639 | A | 5/1957 | Hire |
| 2,800,008 | A | 7/1957 | Raczynski |
| 2,819,540 | A | 1/1958 | Toma et al. |
| 2,824,385 | A | 2/1958 | Toma |

(List continued on next page.)

OTHER PUBLICATIONS

Cissell Service manual, 1961—3 pages, Cissell Manufacturing Co, Inc. Louisville, KY.
Cissell Service manual, 1980, 2 pages (p.28), Cissell Manufacturing Co., Inc. Louisville, KY.

*Primary Examiner*—Pamela A Wilson
(74) *Attorney, Agent, or Firm*—Polster, Lieder, Woodruff & Lucchesi

(57) ABSTRACT

A clothes dryer is provided with a fire detection and suppression system which releases a fire suppressing substance into the dryer chamber upon detection of a fire condition. The fire detection and suppression system includes, a controller, at least one temperature detector which is in communication with the controller and sends a signal to the controller when a temperature set point has been reached and/or exceeded, a source of fire suppressing substance (preferably water) which is delivered to the chamber over a pathway; and a valve in the pathway controlled by the controller. The controller opens the valve when a fire condition is detected, and closes the valve after a time sufficient to introduce a predetermined volume of the fire suppressing substance has passed. The dryer can include a flow detector, such as a pressure sensor or flow rate sensor, which will send information to the controller to enable the controller to determine how long the water valve needs to remain opened to deliver the predetermined amount of fire suppressing substance to the chamber.

16 Claims, 2 Drawing Sheets

U.S. PATENT DOCUMENTS

| | | | | | |
|---|---|---|---|---|---|
| 2,824,386 | A | | 2/1958 | Stone | |
| 2,843,944 | A | | 7/1958 | Toma et al. | |
| 2,864,175 | A | | 12/1958 | Stone | |
| 2,869,247 | A | | 1/1959 | Metzger | |
| 2,878,579 | A | | 3/1959 | Fuchs | |
| 3,044,181 | A | | 7/1962 | Berenbaum | |
| 3,096,164 | A | | 7/1963 | Stone | |
| 3,112,187 | A | | 11/1963 | Stone | |
| 3,125,422 | A | | 3/1964 | Thunander | |
| 3,149,708 | A | | 9/1964 | Forse | |
| 3,155,462 | A | | 11/1964 | Erickson et al. | |
| 3,198,903 | A | | 8/1965 | Chafee, Jr. | |
| 3,229,380 | A | | 1/1966 | Worst | |
| 3,508,340 | A | | 4/1970 | Kombol | |
| 3,633,620 | A | | 1/1972 | Scott | |
| 3,635,645 | A | | 1/1972 | Scott | |
| 3,670,143 | A | | 6/1972 | Zenz | |
| 3,799,387 | A | | 3/1974 | Zenz | |
| 4,036,152 | A | | 7/1977 | Bright | |
| 4,083,118 | A | | 4/1978 | Cotton | |
| 4,689,896 | A | | 9/1987 | Narang | |
| 4,795,871 | A | | 1/1989 | Strattan et al. | |
| 4,827,627 | A | | 5/1989 | Cardoso | |
| 4,891,892 | A | | 1/1990 | Narang | |
| 4,930,579 | A | | 6/1990 | George | |
| 5,161,314 | A | * | 11/1992 | Souza | 34/493 |
| 5,272,781 | A | * | 12/1993 | Bastin et al. | 8/158 |
| 5,396,715 | A | * | 3/1995 | Smith | 34/261 |
| 5,606,804 | A | * | 3/1997 | Smith et al. | 34/261 |
| 5,755,041 | A | | 5/1998 | Horwitz | |
| 6,158,148 | A | | 12/2000 | Krausch | |
| 6,655,047 | B2 | * | 12/2003 | Miller, II | 34/544 |

* cited by examiner

CLOTHES DRYER WITH FIRE SUPPRESSION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This Invention relates generally to clothes dryers, and, In particular to a clothes dryer having a fire suppression system.

Typical clothes dryers circulate heated air through a tumbler or rotating basket in order to dry wet clothes. In some instances, hot spots may develop. For example, a zipper pull, snap, or button can become hot and form a hot spot. In some instances, this hot spot can start clothes to smolder within the dryer. If not detected, the fire can spread within the dryer. It is thus desirable to detect the possibility of a fire condition within the drier.

BRIEF SUMMARY OF THE INVENTION

Briefly stated, a clothes dryer of the present invention comprises a chamber having an inlet and an outlet, a perforated basket rotatable in the chamber, a heater which delivers heated air through the chamber inlet to the chamber, and a blower which forces air to pass along an air path from the inlet, through the basket, and out the outlet The dryer also includes a controller which is used to operate the clothes dryer. The controller is provided with a fire detection and suppression system which will detect a fire condition within the chamber and upon detection of a fire condition, activate a fire suppression system. The fire detection and suppression system includes, in addition to the controller, at least one temperature detector located proximate the chamber and which is in communication with the controller, a source of fire suppressing substance (preferably water) which is delivered to the chamber over a pathway; and a valve in the pathway controlled by the controller. The temperature detector sends a signal to the controller when a set point at the location of the temperature detector has been reached and/or exceeded. Preferably, the fire detection and suppression system includes two temperature detectors—one at the inlet to the chamber and one at the outlet to the chamber. The controller opens the valve when a fire condition is detected, and closes the valve after a time sufficient to introduce a predetermined volume of the fire suppressing substance has passed. The inlet and outlet temperature detectors are preferably normally opened bi-metal thermostats which close a circuit when the set point temperature is reached and/or exceeded. The dryer can include a flow detector, such as a pressure sensor or flow rate sensor, which will send information to the controller to enable the controller to determine how long the water valve needs to remain opened to deliver the predetermined amount of fire suppressing substance to the chamber. The dryer can also be provided with an alarm which is activated by the controller when the controller detects a fire condition (i.e., when the set point at either of the temperature detectors is reached and/or exceeded).

The fire detection and suppression system operates as follows: based on the signal from the temperature detector, the controller determines if a fire condition exists. The controller will determine that a fire condition exists when it receives a signal from the temperature detectors that the set point for the detectors has been reached and/or exceeded. The controller will then deactivate the heater, the blower, and the basket motor, if they are running, and open the valve to allow the fire suppression material to enter the chamber. Once a predetermined amount of the fire suppressing material has entered the chamber, the controller will close the valve. If the dryer is provided with a flow detector, the controller will, based on the output from the flow detector, determine the amount of time required to release the predetermined amount of the fire suppressing material into the chamber. The closing of the valve occurs when the time period has elapsed. If the dryer does not include a flow detector, the controller can determine the required time period based upon the pressure in the flow path of the fire suppressing material. While fire suppressing material is being delivered to the camber, the controller will periodically activate the basket motor to jog the basket

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
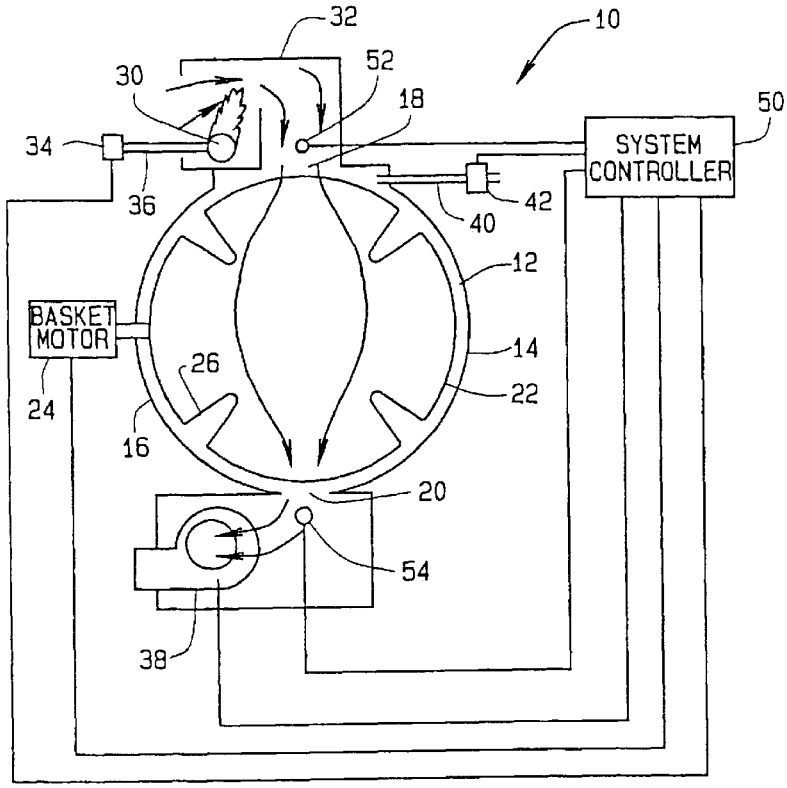
FIG. 1 is a schematic drawing of a dryer incorporating a fire suppression system of the present invention.
Figure 2:
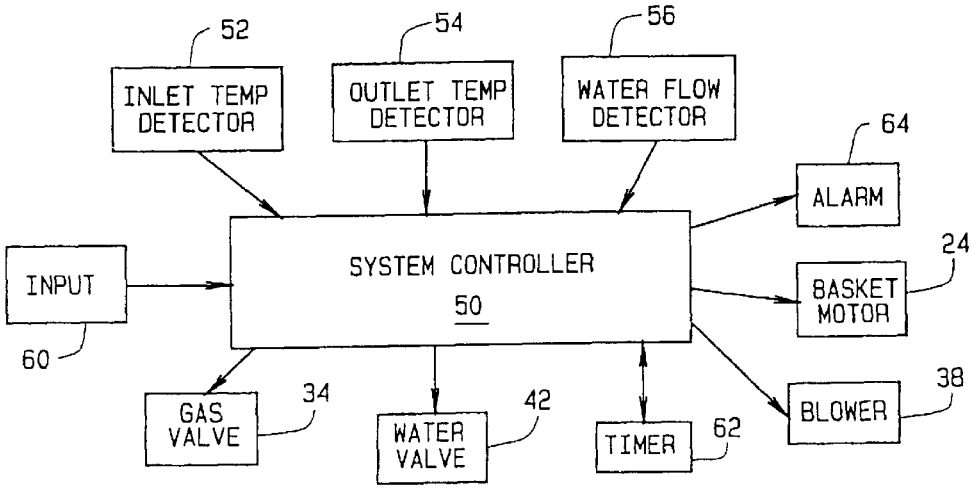
FIG. 2 is a block diagram of the fire suppression system.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A clothes dryer 10 includes a housing (not shown) with a chamber 12 formed within the housing. The chamber 12 is defined by a pair of curved walls 14 and 16 such that the chamber is generally cylindrical in shape. The walls 14 and 16 are spaced apart at their tops and bottoms to form an air inlet 18 at the top and an air outlet 20 at the bottom.

A basket 22 is mounted in chamber for rotation in the chamber. A basket motor 24 is operatively connected to the basket to rotate the basket. The basket comprises a back wall and a side wall, and is open at its front to receive clothes. The basket 22 can be provided with baffles on the side wall to facilitate the tumbling, and hence drying, of clothes within the basket during operation of the dryer. The basket also includes a plurality of openings in the side wall to allow air to pass through the basket. Openings can also be provided in the back wall, if desired. The openings are preferably in the form of perforations, but could be formed as slots or any other type of opening.

The dryer 10 of FIG. 1 is a gas fired dryer, and hence, includes a burner 30 contained within a bonnet 32. The burner 30 is adjacent the air inlet 18, so that it will supply heated air to the chamber 12. The burner 30 is in communication with a source of gas over a gas line 36. A gas valve 34 is positioned in the gas line 36 to control the flow of gas to the burner 30. The gas valve 34 is moveable between an opened position in which gas can flow to the burner and a closed position in which gas flow to the burner is prevented.

A blower 38 is placed beneath the outlet 20. The blower is operated to pull air through the chamber, from the air inlet to the air outlet. Hence, the blower is positioned to force air out of the housing through an exhaust tube (not shown).

The dryer also includes a water line 40 which is connected to a source of water and which opens into the chamber. A water valve 42 is provided in the water line, and is moveable between an opened position in which water can flow into the chamber and a closed position in which water flow to the chamber is prevented.

A controller 50 is provided to control the operation of the dryer 10. The gas valve 34 and water valve 42 are operatively connected to the controller 50, so that, in response to predetermined operating conditions or commands, the controller can open and close the water and gas valves. The valves can, for example, be solenoid operated valves. The basket motor 24 and blower 38 are also operatively connected to the controller, so that the controller can activate and deactivate the basket motor and blower in response to predetermined operating conditions and commands.

The dryer includes two temperature detectors: an inlet temperature detector 52 and an outlet temperature detector 54. The inlet temperature detector 52 is located at the air inlet 18 to detect the temperature of the heated air entering the chamber 12. The outlet temperature detector 54 is located in the exhaust stream (i.e., after the outlet 20) to detect the temperature of the air exiting the chamber 12. The two detectors are preferably normally opened bi-metal disc thermostats or switches (such as are available from Thermo-Disc, Inc. of Mansfield, Ohio) which close a circuit when a predetermined temperature is reached. Preferably, the inlet temperature detector 52 is activated (or closes) if the air temperature exceeds 280° F. (138° C.), and the outlet temperature detector 54 is activated (or closes) if the exhaust air temperature exceeds 230° F. (110° C.). When the detectors 52, 54 are activated, they close a circuit to send a signal to the controller 50 that the set point temperature at the inlet or outlet has been reached and/or exceeded. When the controller receives the signal that the set point temperature at either the inlet or outlet has been reached and/or exceeded, the controller 50 will determine that a fire condition exists in the chamber 12. As can be appreciated, the temperature of the inlet and outlet air at the detector depends on the proximity of the temperature detector to the source of heat. Hence, the temperature at which the detectors are activated can be varied based on their positions in the dryer. Because the inlet temperature detector is near the burner, if the detector were moved close to the inlet, then the set point could be lowered. Conversely, if it were nearer the burner, the set point could be higher. Similarly, if the outlet temperature detector were moved further from the chamber in the exhaust stream, the set point would be lowered, and if it were moved closer to the chamber, the set point would be higher. Although bi-metal thermostats are preferred, other types of temperature detectors could be used. For example, thermistors or infrared sensors could be used. Further, one type of detector could be used at the inlet and a different type of detector could be used at the outlet.

Additionally, the dryer can be provided with a detector 56. As described below, when a fire condition is detected, the controller will open the water valve 42 to allow a predetermined volume or amount of water to enter the chamber 12. The detector 56 will send a signal to the controller to enable the controller to determine how long the valve should be opened in order to allow the predetermined volume of water to enter the chamber 12. The detector 56 can be in the form of a pressure sensor which monitors the pressure in the water line 40. Alternatively, the water flow detector can be a flow rate detector which emits a signal indicative of the rate at which the water is flowing through the water pipe 40. To account for any change in water pressure or flow rate, the detector 56 is preferably positioned after (on the chamber side) the valve 42. However, if desired the detector can be positioned before (on the supply side) the valve 42. As a further alterative, the detector 56 can be omitted in its entirety, and the pressure in the water supply can be used to determine the time that the valve 42 needs to be opened.

In operation, a user will set a desired drying cycle using an input panel 60 located on the housing. As is common, such an input can allow the user to set the drying temperature (i.e., low, medium, high), to set the drying time or the amount of moisture to be removed from the clothing, and to set the drying cycle (i.e., delicates, permanent press, etc.). As is common, this parameter will be set using switches, buttons, and/or dials. The input will also have a switch, button, or dial to allow the user to start the drying cycle. The "start" switch can be incorporated into one of the switches, buttons, or dials used to set the operating parameter of the dryer. Based on the user's inputs, the controller will, after the user initiates the drying cycle, activate a timer 62; activate the blower to begin pulling air through the dryer, from the inlet, through the basket, and out the outlet, activate the basket motor 24 to start rotation of the basket 22, and open the gas valve 34 and ignite the gas at the burner 30 to heat the incoming air. When the user activates the drying cycle, the controller 50 will set the timer 62 for the predetermined amount of time set by the user. Assuming a normal drying cycle, the controller will, after the timer 62 indicates that the drying time is over, turn off the burner 30 by shutting the gas valve 34 and stop the basket motor 24. As is known, the dryer, rather than running for a predetermined period of time, can be set to end the drying cycle when the clothes have reached a certain level of dryness. In such a case, the dryer will include a detector to monitor the humidity of the air within the chamber or in the exit stream, and, based upon the output of the humidity detector, the controller will stop the drying cycle when the predetermined moisture level of the clothes has been reached.

Additionally, once the drying cycle is over, the controller will initiate an anti-wrinkle cycle. In the anti-wrinkle cycle, the controller will activate the basket motor to rotate the basket for a predetermined period of time (i.e., 3 minutes) every 15 minutes, or such other time interval as may be desired. Tumbling of the clothes in the basket will prevent the clothes from sitting in one position for an extended period of time, and hence, will reduce the wrinkling of the clothes. The anti-wrinkle cycle is continued until the controller determines that the dryer door has been opened. Once the user opens the dryer door, the anti-wrinkle cycle is turned off.

During the drying cycle, the controller monitors the signals from the temperature detectors 52 and 54. Because the detectors are, as noted, preferably, bi-metal disc thermostats, which are normally opened, there will be no signal from the detectors unless their set point is reached. As noted above, the set point for the inlet temperature detector 52 is 280° F. (138° C.) and the set point for the outlet temperature detector is 230° F. (110° C.). These set points can be changed, depending on the dryer model or on the setting for a particular dryer model. That is, it may be desirable to use different set points for a delicate cycle and a permanent press cycle on the same dryer. Also, it may be desirable to use different sent points for an industrial dryer and a residential dryer. If the temperature at the inlet or outlet meets or exceeds these respective set points, the bi-metal discs will close to complete a circuit. The closing of the circuit will send an electrical signal to the controller 50 indicating that the set point has been reached and/or exceeded, and the controller will then activate the fire suppression routine, shown in FIG. 3.

Figure 3:
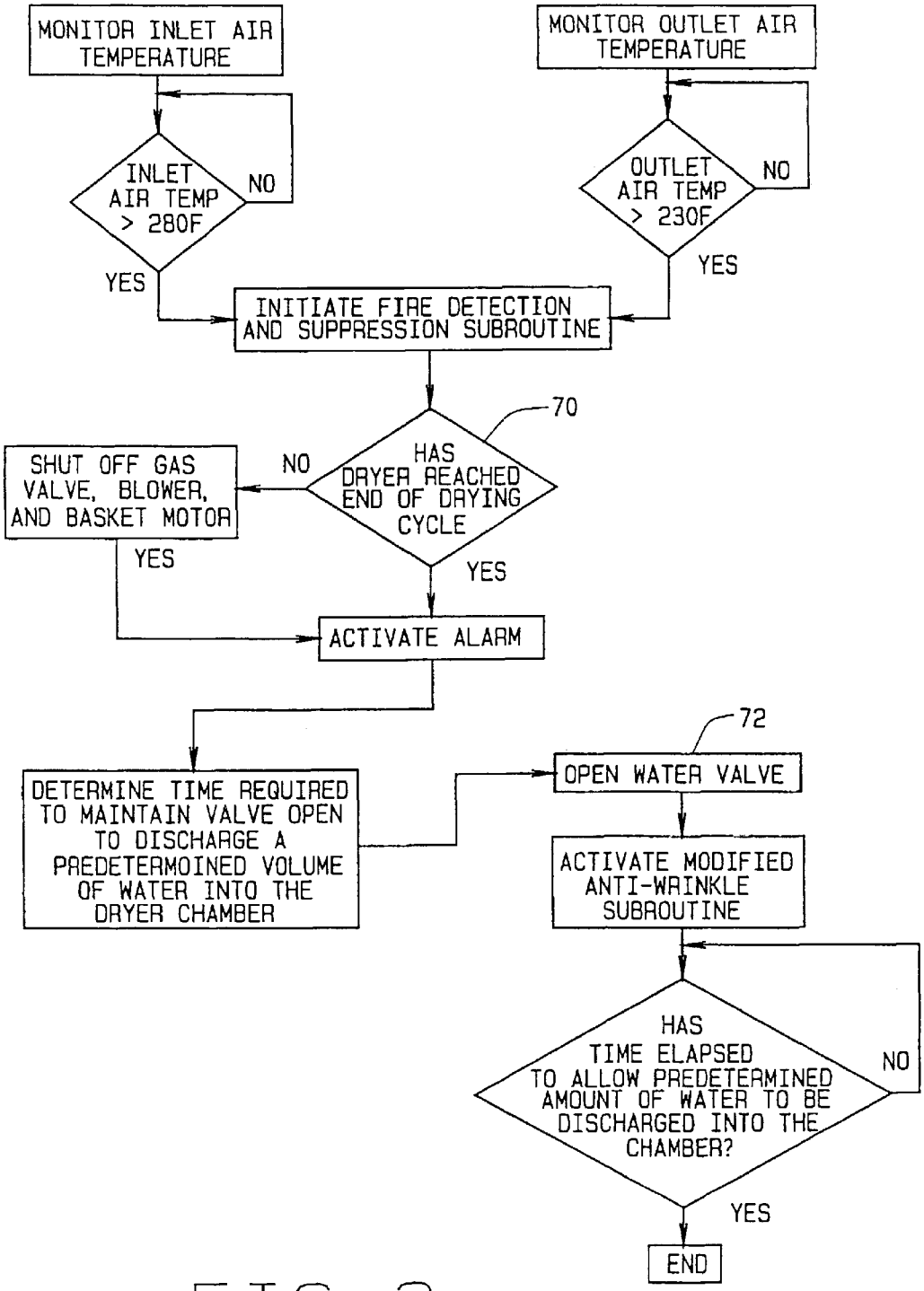
FIG. 3 is a flow chart showing the operation of the fire suppression system.

As shown in FIG. 3, when the fire suppression system is activated, the controller will determine at 70 if the dryer has reached the end of the drying cycle. If the dryer has not reached the end of the drying cycle, the controller will close the gas valve 34 to turn off the burner 30, and turn off the blower 38 and the basket motor 24. The controller 50 will then, at 72, open the water valve to initiate the flow of water into the basket. The controller will keep the valve open until a predetermined volume of water has been released into the basket. As discussed below, the controller determines the amount of time required for the predetermined volume of water to enter the chamber based on the flow of water through the supply line 40. Hence, when the water valve 42 is opened, the controller will calculate the required time. After this time period as elapsed, the controller will close the water valve 42.

The amount of water which is allowed to enter the basket depends on the size of the basket. For example, for a basket having a volume of 50 $ft^3$, 10 gallons of water enter the basket; and for a basket volume of 30 $ft^3$, 6 gallons of water enter the basket. After the predetermined volume of water has entered the chamber 12, the controller closes the water valve 42.

The flow rate of water into the chamber (and hence the time required for the predetermined amount of water to enter the chamber), as is known, is dependant upon the diameter of the water pipe and the pressure or flow rate of the water within the pipe. Thus, using the output of the detector 56, the controller can calculate the flow rate of water through the supply pipe 40, and hence the amount of time required to discharge the predetermined volume of water into the chamber 12. If a water detector 56 is not used, the flow rate can be calculated based on the average water pressure in the water supply line. Water pressure in a typical city water supply is generally about 50 psi to 100 psi. Thus, by using the pressure for the city in which the dryer is located, the time required to discharge the predetermined amount of water can be calculated using known equations.

During the discharge of the water into the chamber, the controller activates a modified anti-winkle routine. Rather than rotate the basket for 3 minutes out of every 15 minutes, the controller will cause the basket to rotate for 2 seconds every 17 seconds. These time parameters can be altered as desired. As can be appreciated, the basket will not make a complete rotation, but rather will be jogged about its axle or shaft. In fact, depending on the amount of time required to discharge the predetermined amount of water into the chamber, the basket may not complete a full rotation, or may complete more than one rotation. Rotation, or jogging, of the basket, helps wet more of the clothes within the basket, to better ensure that any hotspot is exposed to water.

To alert the operator to the fact that a fire condition has been detected, the controller can also activate an alarm 64 upon activation of the fire suppression subroutine. The alarm can be a visual and/or audible alarm.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense. Although water is preferred as a fire suppressing substance because of the ready availability of, and easy access to, water, other substances could be used in lieu of water. For example, a gas, such as carbon dioxide or another non-combustible gas could be used as the fire suppressing material. The switches 52 and 54 could be normally closed switches rather than normally opened switches. In this case, the switches would opened with a predetermined temperature is reached. In either event, in response to the change in signal from the switch, the controller will initiate the fire suppression subroutine. Although the invention is disposed for use with a gas dryer, the fire detection and suppression system of the present invention can be incorporated in an electric dryer. In this instance, the controller would activate and deactivate heating elements in the same manner the gas burner is activated and deactivated as described above. Although the fire detection and suppression system is described to include two temperature detectors, it could function with a single temperature detector. Such a single temperature detector could be positioned at the inlet, outlet, or within the chamber itself. These examples are merely illustrative.

What is claimed is:

1. A clothes dryer comprising a chamber having an inlet and an outlet; a basket rotatable in the chamber, the basket including openings to allow air to flow through the basket; a heater which delivers heated air through the chamber inlet to the chamber; and a blower which forces air to pass through the inlet, the basket, and out the outlet; the improvement comprising a fire suppression system; the fire detection and suppression system comprising:

a controller;

at least one temperature detector adjacent said chamber, said temperature detector being operatively connected to said controller to send a temperature signal to said controller, said temperature signal being indicative of a temperature of said chamber; said controller detecting the presence of a fire condition based on the signals from said temperature detector;

a source of a fire suppressing substance, a pathway to deliver said fire suppressing substance to said basket, and a valve in said pathway; said valve being moveable between a closed position in which said fire suppressing substance is prevented from entering the basket and an open position in which said fire suppression substance can be introduced into said basket;

said valve being operatively connected to said controller; said controller opening said valve when a fire condition is detected for a time sufficient to introduce a predetermined volume of said fire suppressing substance into said basket.

2. The improvement of claim 1 wherein said fire suppressing substance is water.

3. The improvement of claim 1 wherein said temperature detector is a bi-metal thermostat; said temperature detector sending a signal to said controller when a predetermined temperature at said detector is reached and/or exceeded.

4. The improvement of claim 3 wherein said bi-metal thermostat is a normally opened bi-metal thermostat.

5. The improvement of claim 1 wherein said temperature detector is located at said chamber inlet and comprises an inlet temperature detector; said fire detection and suppression system also including an outlet temperature detector located adjacent said chamber outlet.

6. The improvement of claim 1 wherein said controller closes said valve after said predetermined amount of fire suppressing material has been delivered to said basket.

7. The improvement of claim 1 wherein said controller activates an alarm when a fire condition is detected; said alarm being a visual and/or audible alarm.

8. The improvement of claim 1 wherein said controller turns off said heater, said basket motor, and said blower, if said heater, basket motor or blower are activated when a fire condition is detected.

9. The improvement of claim 1 wherein said controller periodically jogs said basket while said valve is opened.

10. The improvement of claim 1 including a flow detector in operative communication with said controller; said controller using output from said flow detector to determine the amount of time necessary for the predetermined volume of water to be discharged into said chamber.

11. The improvement of claim 10 wherein said flow detector is a pressure sensor or a flow rate sensor.

12. A method for detecting and suppressing a fire condition in a clothes dryer; the clothes dryer including a chamber, a basket mounted within said chamber to be rotated within said chamber, a motor for rotating said basket, an air inlet into said chamber, a heater for heating air entering said chamber, air outlet, and a blower for forcing air through an air path from said inlet, through said basket, and out said outlet; said method comprising;

determining if a set temperature at a selected point in said air path has been reached or exceeded;

releasing a fire suppressing material into said basket when said set temperature is exceeded; and stopping the flow of said fire suppressing material after a predetermined amount of said material has been introduced into said basket.

13. The method of claim 12 including a step of determining the amount of time required to release the predetermined amount of said fire suppressing material into the chamber.

14. The method of claim 13 wherein said step of determining the amount of time includes receiving information regarding the pressure or flow rate of said fire suppressing material entering the chamber.

15. The method of claim 12 wherein said method includes periodically activating said basket motor to jog said basket while said fire suppressing material is being introduced into said basket.

16. The method of claim 12 including a step of determining if said basket motor, heater, and blower are activated prior to releasing said fire suppressing material into said chamber, and deactivating said basket motor, heater, and blower if they are activated prior to opening release of fire suppressant material into said basket.

* * * * *